United States Patent [19]

Leclerc

[11] 4,008,548

[45] Feb. 22, 1977

[54] PLAYING SURFACE

[76] Inventor: Raymond W. Leclerc, 1045 Oakhill Road, Fitchburg, Mass. 01420

[22] Filed: Sept. 24, 1975

[21] Appl. No.: 616,497

[52] U.S. Cl. ..... 52/180; 52/581; 52/591

[51] Int. Cl.[2] ..... E04F 15/00

[58] Field of Search ..... 52/177, 180, 591, 581; 46/25–31; 404/36; 15/215, 238; 272/3; 273/29 R

[56] References Cited

UNITED STATES PATENTS

| | | | |
|---|---|---|---|
| 2,119,921 | 6/1938 | Levy | 46/25 |
| 2,961,779 | 11/1960 | Perry | 46/31 |
| 3,438,312 | 4/1969 | Becker | 52/177 |
| 3,581,630 | 6/1971 | Del Piano | 404/41 |
| 3,694,983 | 10/1972 | Couquet | 52/592 |
| 3,740,914 | 6/1973 | Diez | 52/591 |
| 3,802,144 | 4/1944 | Spica | 52/177 |
| 3,868,798 | 3/1975 | Spica | 52/177 |
| 3,960,375 | 6/1976 | Roubi | 404/41 |

FOREIGN PATENTS OR APPLICATIONS

| | | | |
|---|---|---|---|
| 579,912 | 8/1946 | United Kingdom | 404/36 |

*Primary Examiner*—John E. Murtagh
*Attorney, Agent, or Firm*—Charles R. Fay

[57] ABSTRACT

Multiple plastic molded squares with means to interlock strips of the same so the entire surface expands and contracts during changes in temperature without creating distortion. The top surfaces are rough and under the top surface there are a plurality of projections for supporting the playing surface raised from an underlying base surface.

4 Claims, 7 Drawing Figures

PLAYING SURFACE

BACKGROUND OF THE INVENTION

There has been a problem in recent years of providing improved floor surfaces for playing sports such as tennis, basketball, street hockey, track, etc. The well-known synthetic turf has been one solution but the present invention presents an advance in that interchangeable raised surfaces are provided, this surface being non-skid and in any size desired. It can be placed on any sub-surface desired and can also be used for floor mats, shower stalls, around pools and patios, etc.

SUMMARY OF THE INVENTION

The present invention provides a playing surface formed in multiple three inch squares having a roughened upper surfaces which are generously apertured, and the surface areas are provided with small raised projections so that the entire surface is nonskid. Each block or strip of 3 inch squares is provided with means for interlocking with other similar blocks or strips and a complete playing floor can be put down (and taken up) rapidly covering any size of surface desired. Along an edge of each block or strip there are provided loop interlocking devices, and pins interlocking at opposite sides thereof for interlocking with another block or strip. An end square is provided with similar interlocking means to interlock with another strip in extension thereof. The playing surface is raised a fraction of an inch from the sub-surface and is formed with adequate downwardly projecting hollow and solid members to adequately support the playing surface in raised condition from the sub-surface.

PREFERRED EMBODIMENT OF THE INVENTION

Figure 1:
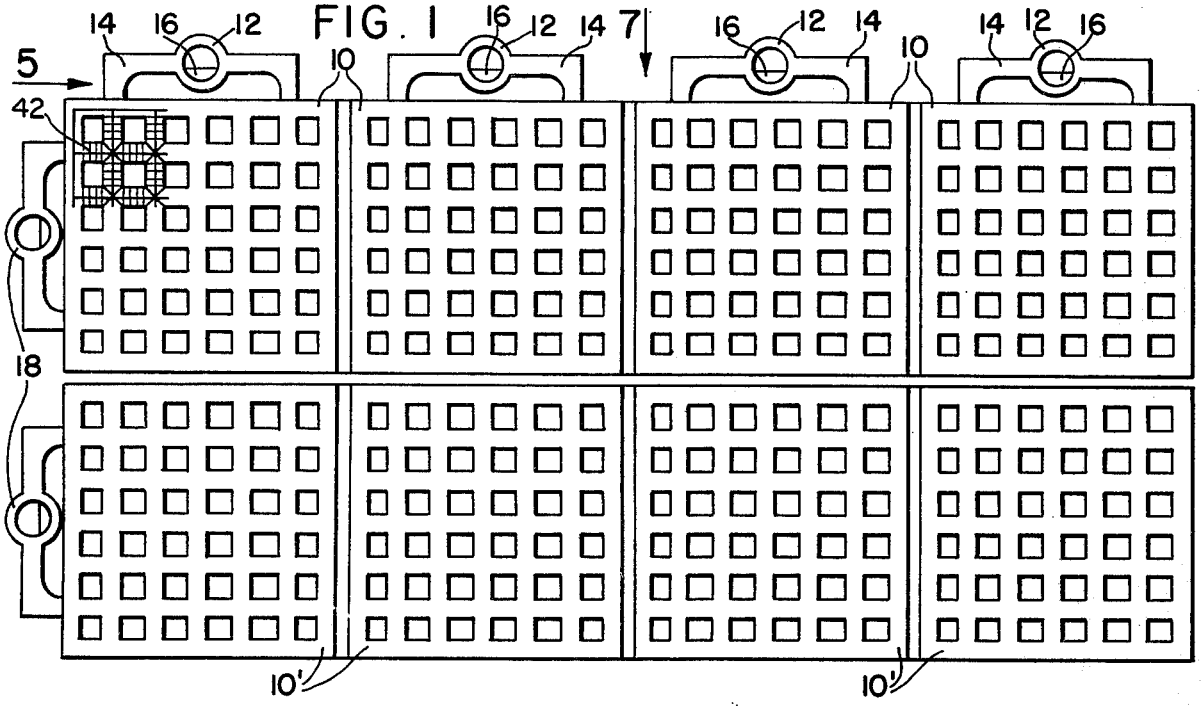
FIG. 1 is a plan view showing two strips interlocking.

In FIG. 1 there are shown two strips of the new surface material which are interlocked. Each comprises four 3 inch squares 10 and 10'. Each square is molded in a perforated form as shown with non-skid marks at the top surface thereof. In this illustration the apertures shown are square but may be of any shape also, of course, the four squares in each strip may be oblong if desired, and of any number.

Each square is provided with an interlocking loop indicated at 12, 12, and each loop is securely fastened by means of braces 14 integral with the respective square. The loops 12 are each provided with a slanted inwardly extended tooth 16 for cooperation with a cooperating snap interlocking pin to be described.

At the end of each strip there is a similar loop and supporting bracket 18—18 for the attachment of other strips in elongation, the loops 12 being adapted for attachment between the upper strip in FIG. 1 and another strip and so on. The strip comprised of squares 10' are also provided with snap loops such as those at 12 for snap interlock with pins also to be described in squares 10—10 but these have been omitted from FIG. 1 for clarity of illustration.

Each of the squares is substantially rigid but is attached by means of a flexible dependent U-shaped strip 20 so that the individual courses of strips can be slightly flexed relative to each other if this should become necessary during installation.

Figure 2:
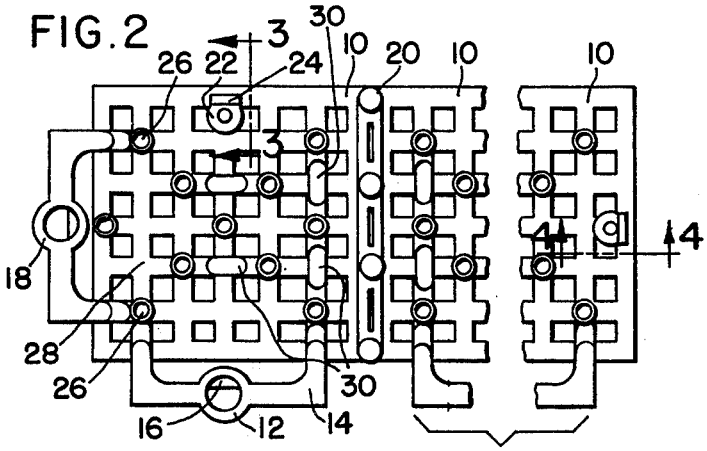
FIG. 2 is a bottom plan view of one of the strips with parts broken away.
Figure 3:
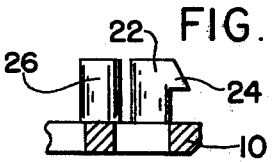
Figure 5:
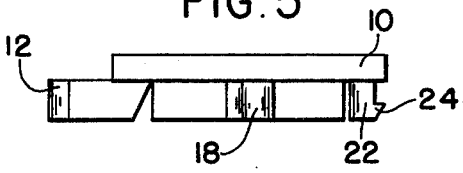
FIG. 5 is an end view looking along arrow 5 in FIG. 1.

Referring now to FIG. 2 the underlying construction will be seen, including loop 12, bracket 14 and interlocking snap over tooth 16. The loop 12 extends outwardly of the major confines of its respective square and at the opposite edge thereof there is a depending pin 22 which has an interlocking snap over tooth 24 as seen in FIG. 3, and this is adapted to snap into the loop 12 of the next adjacent row of squares.

A series of open cylinders 26 are arranged on various cross bars such as 28 and here and there there are placed solid pillars or columns 30—30. These act to support the plastic flooring in elevated position from the sub-surface in the areas not provided with loops 12 or pins 22 so that a firm solid foundation is presented.

Figure 4:
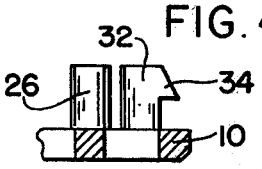
FIGS. 3 and 4 are sectional views on the respective lines on FIG. 2 on enlarged scale.

Referring now to FIG. 4, this is a cross-section on line 4—4 of FIG. 2 and shows a pin 32 having a snap over interlock 34 which is just the same as before described as to pin 22 and is for the purpose of accepting loop 18 of another strip.

Figure 6:
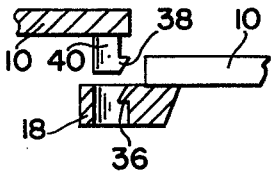
FIG. 6 is a detached view illustrating the pin and loop interlocking means.
Figure 7:
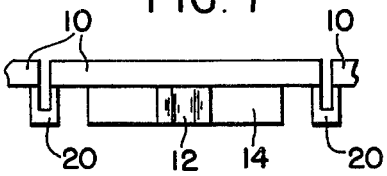
FIG. 7 is a view in edge elevation looking in the direction of arrow 7 in FIG. 1.

FIG. 6 illustrates how the squares or strips of squares are snapped together therebeing the snap over tooth 36 located in loop 18, and cooperating snap over tooth 38 on pin 40, which is the same as pins 22 and 32. It is merely necessary to snap the parts together, tooth 38 passing tooth 36 to rigidly hold the parts in a similar relation.

The top surfaces of the strips of this invention are preferably roughened as shown partially at the top left-hand corner of FIG. 1 at 42 inorder to provide non-skid surfaces.

I claim:

1. A supplementary surface construction comprising a series of rectangular plastic molded one-piece strips, a plurality of apertures in each strip, outstanding interlocking loops integral with each strip arranged along the long side edge thereof, each loop containing a straight edge snap over tooth, outstanding free-ended projections at the two opposite edges from said loops, each projection including a straight side snap over tooth complementary to and for cooperation with the teeth in the loops of the next succeeding strip, and a interlocking snap over loop integral with said strip at one end thereof for interlocking engagement with a projection on an extending strip, a plurality of supporting pins depending from the lower portion of said surface construction to support the same in elevated condition on a supporting floor or ground surface, said loops extending upwardly from the supporting floor only partially to the top surface of the construction and the projections extending substantially the full height of the construction, the loops extending outwardly laterally of the construction, the projections lying wholly within the area of the construction, each of said plastic one-piece molded strips comprising a plurality of generally rigid pieces serially connected in said strip, and flexible means for interconnecting adjacent of said generally rigid pieces in said strip and providing flexibility to said strip.

2. The supplementary surface construction of claim 1 wherein certain of the supporting means pins are free-ended cylinders.

3. The supplementary surface construction of claim 1 wherein the cylinders are hollow.

4. The supplementary surface construction of claim 1 wherein certain of the supporting means pins are solid free-ended pillars.

* * * * *